US010039376B2

(12) United States Patent
Vander Park

(10) Patent No.: US 10,039,376 B2
(45) Date of Patent: Aug. 7, 2018

(54) CONFIGURABLE WORKSTATION

(71) Applicant: NOVA-LINK LIMITED, Mississauga (CA)

(72) Inventor: Antonius A. Vander Park, Caledon (CA)

(73) Assignee: Nova-Link Limited, Mississauga, Ontario (CA)

( * ) Notice: Subject to any disclaimer, the term of this patent is extended or adjusted under 35 U.S.C. 154(b) by 0 days.

(21) Appl. No.: 15/253,284

(22) Filed: Aug. 31, 2016

(65) Prior Publication Data

US 2018/0055215 A1 Mar. 1, 2018

(51) Int. Cl.
*A47B 21/02* (2006.01)
*A47B 21/03* (2006.01)
(Continued)

(52) U.S. Cl.
CPC ..... *A47B 21/02* (2013.01); *A47B 21/0314* (2013.01); *A47B 21/04* (2013.01);
(Continued)

(58) Field of Classification Search
CPC ... A47B 21/02; A47B 21/00; A47B 2021/066; A47B 21/06; A47B 83/001; A47B 21/0314; A47B 21/0073; A47B 2200/0082; A47B 13/003; A47B 2037/005; A47B 87/002; A47B 9/20; A47B 21/04;
(Continued)

(56) References Cited

U.S. PATENT DOCUMENTS 4,838,177 A 6/1989 Vander Park
5,988,076 A * 11/1999 Vander Park ..... A47B 21/06 108/50.02
(Continued)

FOREIGN PATENT DOCUMENTS

CN 203748886 U 8/2014
GB 2345845 A 7/2000
WO 03037140 A1 5/2003

OTHER PUBLICATIONS

Nova-Link Limited, Product p. 6-008, Jul. 17, 2012, Ontario, Canada.
(Continued)

*Primary Examiner* — Hiwot E Tefera
(74) *Attorney, Agent, or Firm* — Hodgson Russ LLP

(57) ABSTRACT

A configurable workstation for communication equipment has a primary support assembly and may have one or more secondary support assemblies behind the primary support assembly to define separate zones that are automatically adjustable in elevation by a motor drive system independently of one another and in synchronization with each other. The primary support assembly may have a work deck, an equipment rack, or a conference table. Each secondary support assembly has an equipment rack. The zones are separated by gap regions permitting recessed positioning of equipment and heat dissipation from a base of the workstation in which computer equipment may be stored. The configurable workstation allows operators to see and be seen, and facilitates ergonomically beneficial positioning of equipment.

15 Claims, 11 Drawing Sheets

(51) Int. Cl.
*A47B 21/04* (2006.01)
*A47B 21/06* (2006.01)

(52) U.S. Cl.
CPC ..... *A47B 21/06* (2013.01); *A47B 2021/066* (2013.01); *A47B 2200/0057* (2013.01); *A47B 2200/0078* (2013.01); *A47B 2200/0079* (2013.01)

(58) Field of Classification Search
CPC .... A47B 2200/0079; A47B 2200/0057; A47B 2200/0078; Y10S 248/917; Y10S 248/919; Y10S 248/92
USPC ..... 108/50.02, 50.01, 147, 20, 147.19; 312/223.3, 223.1, 223.2, 223.6; 248/125.1, 125.2, 127, 276.1, 287.1, 248/295.11, 298.1, 188.2, 157, 429, 248/917–919; 211/26
See application file for complete search history.

(56) References Cited

U.S. PATENT DOCUMENTS 6,076,903 A 6/2000 Vander Park
6,152,048 A 11/2000 Vander Park
7,143,552 B2 * 12/2006 Vander Park ..... A47B 21/06 52/220.7
7,878,476 B2 * 2/2011 Carson ..... B60R 11/0235 211/26
8,596,599 B1 * 12/2013 Carson ..... B60R 11/0235 211/26
9,635,932 B2 * 5/2017 Kelley ..... A47B 21/06
2011/0120351 A1 * 5/2011 Shoenfeld ..... A47B 21/02 108/20
2014/0245932 A1 9/2014 McKenzie
2016/0360879 A1 * 12/2016 Kelley ..... A47B 21/06

OTHER PUBLICATIONS

Nova-Link Limited, Product p. 6-011, Jun. 19, 2012, Ontario, Canada.
Nova-Link Limited, Product p. 6-106, Nov. 14, 2012, Ontario, Canada.
Nova-Link Limited, Product p. 6-108, Nov. 14, 2012, Ontario, Canada.
Nova-Link Limited, Product p. 6-113, Dec. 18, 2012, Ontario, Canada.
Nova-Link Limited, Product p. 6-162, Nov. 27, 2012, Ontario, Canada.
Nova-Link Limited, Product p. 6-214, Mar. 28, 2013, Ontario, Canada.
Nova-Link Limited, Product p. 6-259, Sep. 26, 2013, Ontario, Canada.
Nova-Link Limited, Product p. 6-276, Apr. 29, 2013, Ontario, Canada.
Nova-Link Limited, Product p. 6-591, Nov. 10, 2014, Ontario, Canada.
Nova-Link Limited, Product p. 6-615, Jan. 20, 2015, Ontario, Canada.
Nova-Link Limited, Product p. 7-037, May 11, 2015, Ontario, Canada.
Nova-Link Limited, Product p. 7-041, May 15, 2015, Ontario, Canada.

* cited by examiner

CONFIGURABLE WORKSTATION

FIELD OF THE INVENTION

The present invention relates to workstations at which a variety of communication equipment is made available to one or more operators.

BACKGROUND OF THE INVENTION

In work environments that require intensive communication systems (e.g. air traffic control towers, military command centers, emergency response centers, financial trading centers, etc.), an operator may need to interact with online persons, information, and images while simultaneously monitoring events and communicating in person directly with co-workers present in the same room with the operator. The operator may need access to several equipment interfaces (e.g. touch screens, display screens, speakers, cameras, input devices, etc.) while maintaining the capacity to see and be seen by others in the work environment.

Workstations currently found in these work environments may limit the capacity of the operator to see and be seen. For example, multiple display screens arranged substantially in a single vertical plane may reach a height such that the operator's viewing sightlines with other personnel are blocked.

Another drawback of existing workstations is that they offer limited options for arranging equipment in a comfortable and ergonomic configuration for a particular operator. For example, many current workstations may only be configured for an operator who is sitting, standing, or of a certain height. When an operator prefers sitting to standing, or vice versa, or if an operator's height is atypical, it may be very difficult or impossible to orient multiple display screens at optimal viewing angles and position other equipment within easy reach of the operator. As a result, the operator may experience strain and fatigue.

For some applications, it may be desirable to provide a group workstation wherein a plurality of users may comfortably view and interact with communications equipment.

Intensive communication systems of the type mentioned above typically have multiple computer CPUs and display screens that generate a substantial amount of heat. When the equipment is arranged in close proximity at a single workstation, some of the equipment may be damaged by overheating if heat is not properly dissipated.

What is needed is a configurable workstation that addresses the issues mentioned above.

SUMMARY OF THE INVENTION

The present invention provides a configurable workstation that allows sightlines and direct interaction among operators and other personnel present in the area of the workstation, facilitates adjustments in the position of equipment supported by the workstation for operator-specific ergonomic comfort, and provides heat dissipation pathways to prevent overheating.

In one embodiment, the configurable workstation comprises a base, a primary support assembly, and a motor drive system. The primary support assembly includes a pair of legs mounted to the base and a support component extending horizontally between the pair of legs. The pair of legs are vertically adjustable relative to the base by the motor drive system, whereby an operator can automatically adjust the pair of legs vertically relative to the base to adjust an elevation of the support component. The support component may be a work deck having a flat work surface, or the support component may be a rack configured to support a plurality of display screens. For example, the rack may carry a plurality of adjustable and selectively positionable support brackets each configured to hold a respective display screen. The configurable workstation may further comprise at least one secondary support assembly behind the primary support assembly. The secondary support assembly may include a pair of secondary legs mounted to the base and vertically adjustable relative to the base, a secondary rack extending horizontally between the pair of secondary legs, a pair of support posts extending upwardly from the secondary rack, and at least one equipment rail extending horizontally between the pair of support posts. The motor drive system is operable to automatically adjust the pair of secondary legs vertically relative to the base to adjust an elevation of the secondary rack independently of the support component. Each equipment rail may be vertically adjustable along the pair of support posts relative to the secondary rack, and a plurality of support brackets may be removably mounted on each equipment rail to hold display screens or other equipment. More than one secondary support assembly may be provided behind the primary support assembly.

Where the configurable workstation includes a secondary support assembly behind the primary support assembly, the secondary rack may be spaced apart from the support component of the primary support assembly in a depth direction of the configurable workstation to define a gap region in which a lower portion of a display screen carried by the secondary support assembly is positionable. The gap region also provides a thermal venting path extending upwardly from the base. Likewise, if another secondary support assembly is provided behind the initial secondary support assembly, the respective secondary racks may be spaced apart from one another in a depth direction of the configurable workstation to provide a gap region between the secondary racks.

In another embodiment, the configurable workstation comprises a main base, a support assembly, a conference table, and a motor drive system. The support assembly includes a pair of legs mounted to the main base and vertically adjustable relative to the main base, a rack extending horizontally between the pair of legs, a pair of support posts extending upwardly from the rack, and at least one equipment rail extending horizontally between the pair of support posts. The conference table includes a plurality of legs mounted to the main base that are vertically adjustable relative to the main base. The motor drive system is associated with the pair of legs of the support assembly and with the plurality of legs of the conference table. The motor drive system is operable to automatically adjust the pair of legs of the support assembly to adjust an elevation of the equipment rack. The motor drive system is also operable to automatically adjust the legs of the conference table to adjust an elevation of the conference table independently of the rack. The conference table may be elongated away from the main base, and an auxiliary base may be provided at a location spaced from the main base, wherein the conference table further includes a plurality of auxiliary legs mounted to the auxiliary base and the motor drive system is operable to automatically adjust the auxiliary legs of the conference table for adjusting the elevation of the conference table independently of the rack.

BRIEF DESCRIPTION OF THE DRAWING VIEWS

The nature and mode of operation of the present invention will now be more fully described in the following detailed description of the invention taken with the accompanying drawing figures, in which.

DETAILED DESCRIPTION OF THE INVENTION

Figure 1:
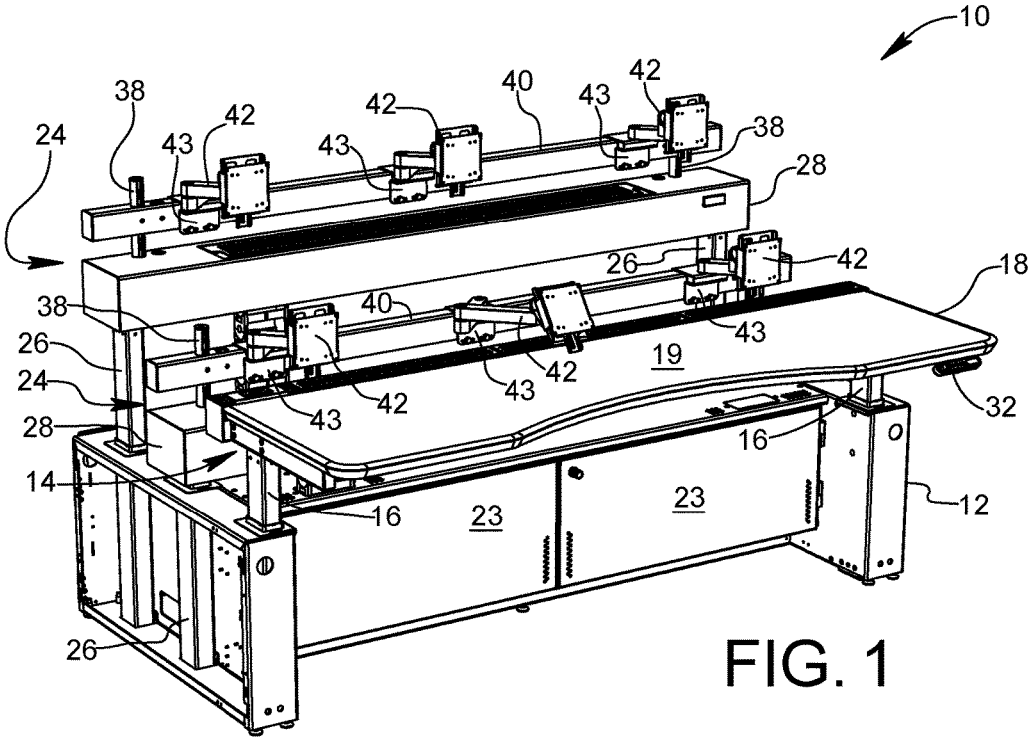
FIG. 1 is a front perspective view of a configurable workstation formed in accordance with a first embodiment of the present invention.
Figure 2:
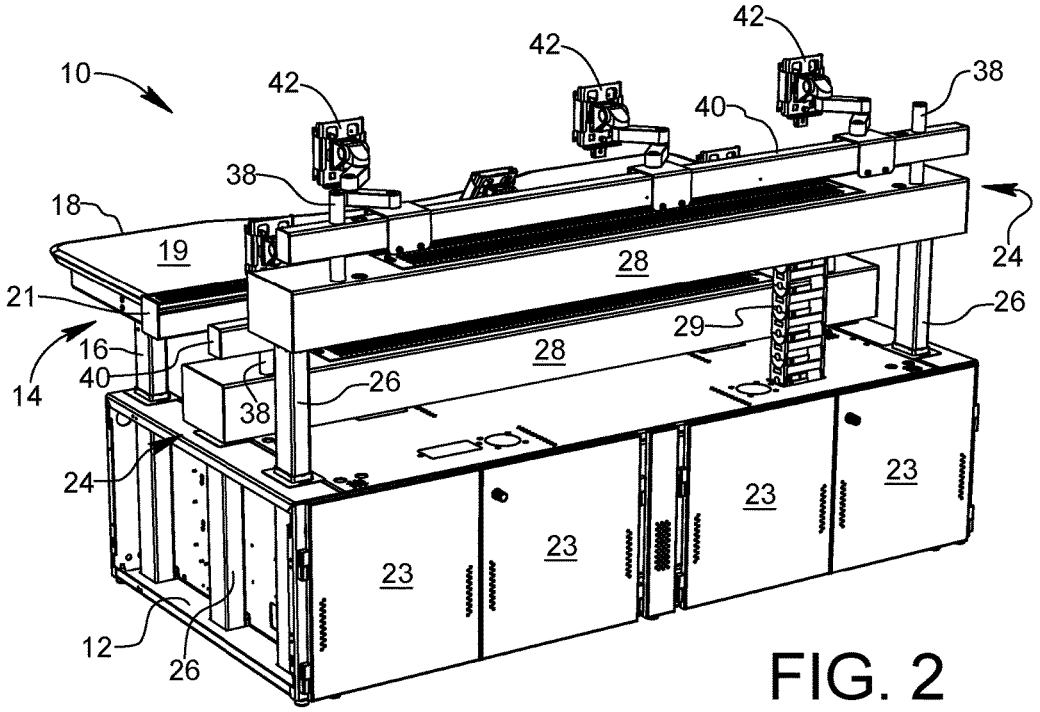
FIG. 2 is rear perspective view of the configurable workstation shown in FIG. 1.
Figure 3:
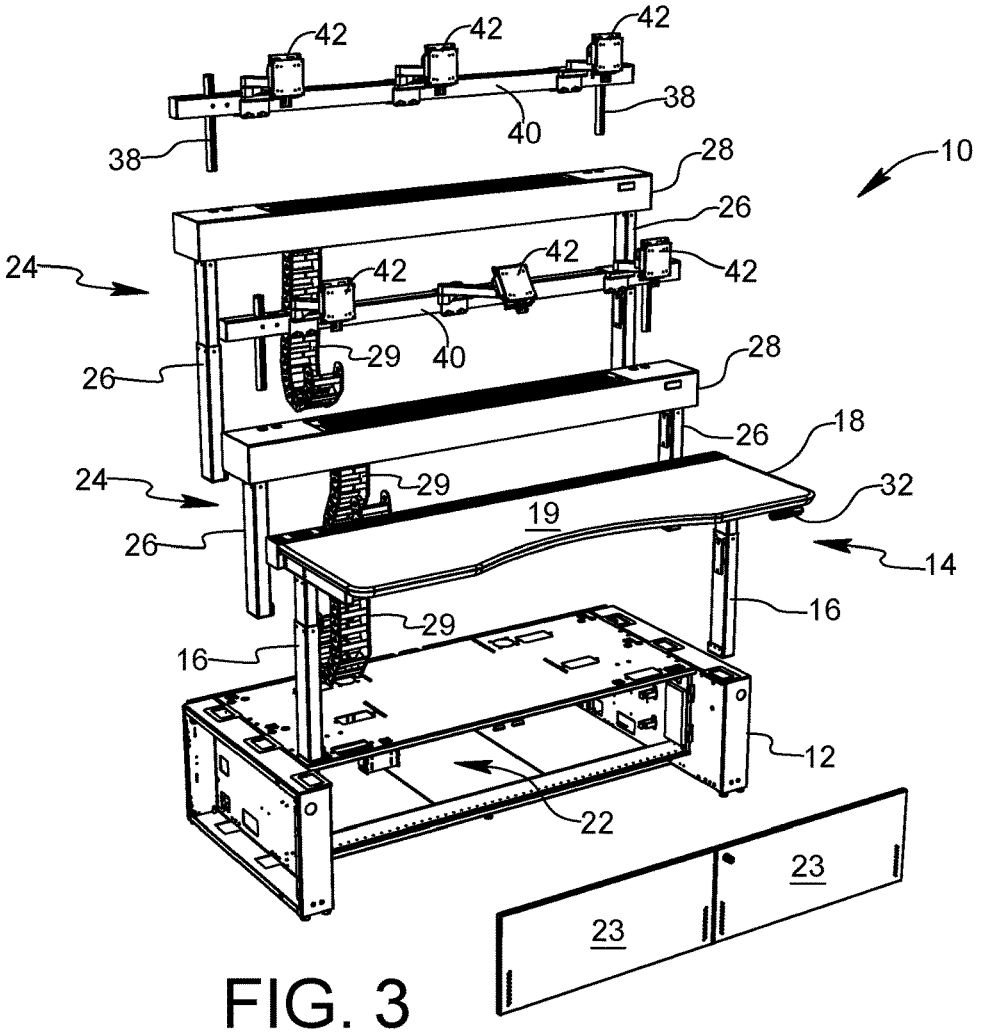
FIG. 3 is an exploded perspective view of the configurable workstation shown in FIG. 1.

FIGS. 1-8 show a configurable workstation 10 according to a first embodiment of the present invention. Workstation 10 comprises a base 12, a primary support assembly 14 including a pair of legs 16 mounted to base 12 and a support component 18 extending horizontally between the pair of legs 16. Legs 16 are vertically adjustable relative to base 12. For example, each leg 16 may have telescopically or slidably adjustable segments such that the overall length of the leg is continuously adjustable between a lower limit and an upper limit. Workstation 10 also comprises a motor drive system 20 (FIG. 8) operable to automatically adjust the pair of legs 16 vertically relative to base 12 to change the elevation of support component 18 and any equipment that may be carried by support component 18.

Base 12 may be in the form of a cabinet having interior space 22 for holding equipment such as one or more computer CPUs, networking cables and interfaces, power supplies, and other equipment associated with workstation 10. The interior space 22 and equipment therein may be accessible via doors 23 on the front and/or back of base 12.

Primary support assembly 14 defines a first or front zone of workstation 10 closest to an operator facing the workstation. As shown in FIGS. 1-7, support component 18 of primary support assembly 14 may be a work deck having a flat work surface 19. Alternatively, as shown in FIGS. 9-12 and discussed later below, support component 18 of primary support assembly 14 may be a rack configured to support a plurality of display screens or other equipment.

Workstation 10 may comprise a plurality of support assemblies each defining a respective zone of the workstation. In the embodiment illustrated in FIGS. 1-8, workstation 10 comprises two secondary support assemblies 24 arranged one after the other behind primary support assembly 14. As may be understood, the depicted workstation 10 is three zones deep. It is possible, however, to configure workstation 10 with only one work zone, with two work zones, or with more than three work zones.

Each secondary support assembly 24 includes a pair of secondary legs 26 mounted to base 12 and vertically adjustable relative to base 12, and a secondary rack 28 extending horizontally between the pair of secondary legs 26. Secondary racks 28 may be utilized to support one or more display screens, including touch screens, behind and above support component 18 of primary support assembly 14. Motor drive system 20 may be configured such that it is operable by a user to automatically adjust each pair of secondary legs 26 of a particular zone vertically relative to base 12 to change the elevation of the associated secondary rack 28 and any equipment that may be carried such secondary rack. As will be understood, motorized vertical adjustment of each zone leg pair 16, 16 and 26, 26 is independent of the motorized vertical adjustment of all other zone leg pairs of workstation 10, whereby support component 18 and each secondary rack 28 is independently settable to a desired elevation by a user in automated fashion.

Figure 8:
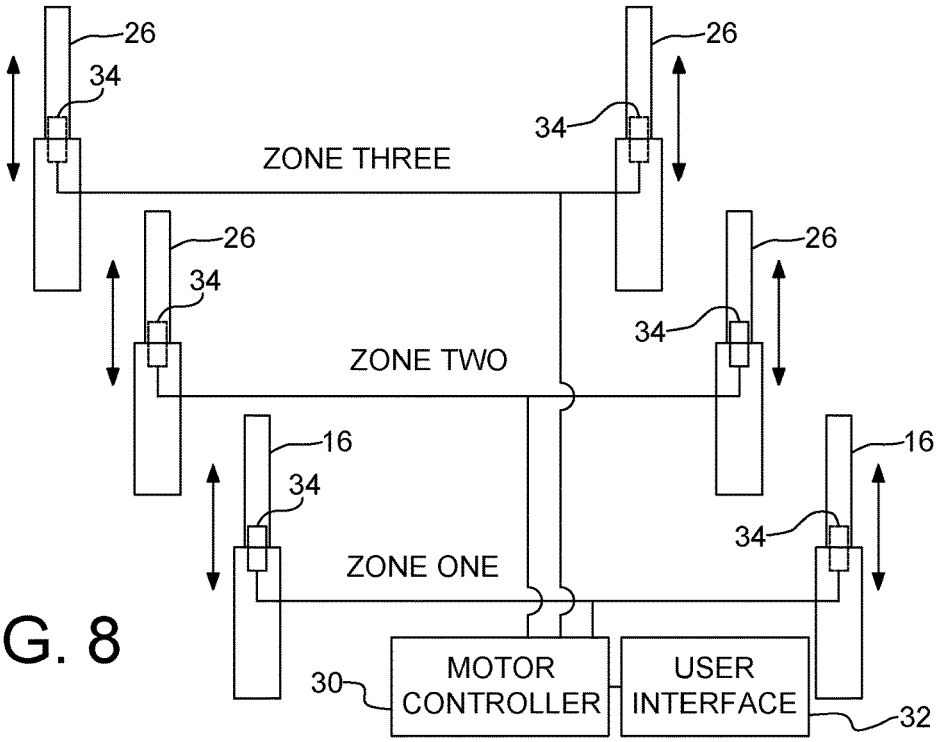
FIG. 8 is a schematic diagram shown motor drive systems of the configurable workstation shown in FIG. 1.
Figure 9:
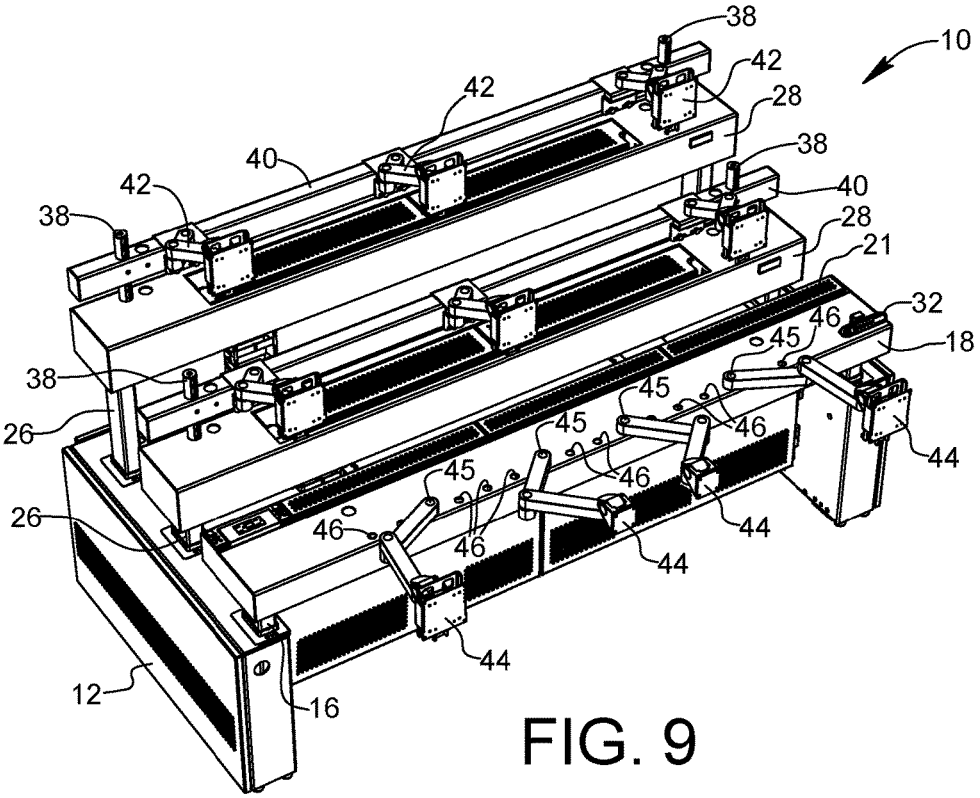
FIG. 9 is a top front perspective view of the configurable workstation shown in FIG. 1, illustrating a variation thereof having a front rack instead of a work deck.

As illustrated schematically in FIG. 8, motor drive system 20 includes a motor controller 30, a user interface 32 connected to the motor controller, and a plurality of electric drive motors 34 associated one with each of the legs 16 and 26 of workstation 10. Motor controller 30 receives input commands from user interface 32 and generates motor command signals for driving motors 34. As may be understood, the paired motors associated with a particular zone may be driven in synchronization with each other to evenly adjust elevation of the equipment in that zone. By way of non-limiting example, motors 34 and legs 16, 26 may be commercially available components provided with the Desklift DL6 lifting column system available from Linak U.S. Inc. of Louisville Ky., which uses telescoping columns (legs) each driven by a compact electric motor. Also by way of non-limiting example, motor controller 30 may comprise one or more DESKLINE® control boxes available from Linak U.S. Inc. For example, Linak's CBD6S control box may be suitable for practicing the present invention. Further by way of non-limiting example, user interface 32 may be a commercially available control interface such as DESKLINE® switch unit available from Linak U.S. Inc. Controller 30 is configured to drive motors 34 in a chosen zone for vertical adjustment of the chosen zone independently of the other zone or zones of workstation 10. Controller 30 may also be configured to drive all motors 34 in all zones of workstation 10 in unison, whereby the entire workstation 10 may be adjusted vertically using a single button or input command, as may be desirable for adjusting the entire workstation between a low elevation for a seated user and a higher elevation for a standing user. Controller 30 may be configured to provide predetermined elevation settings and user-programmed settings for the support assembly 14 or 24 of each zone of workstation 10. Configuration of controller 30 may be realized through the use of executable software instructions stored in memory associated with controller 30. The software instructions may include fixed routines and routines that incorporate user-modifiable parameters or settings entered via user interface 32.

Figure 7:
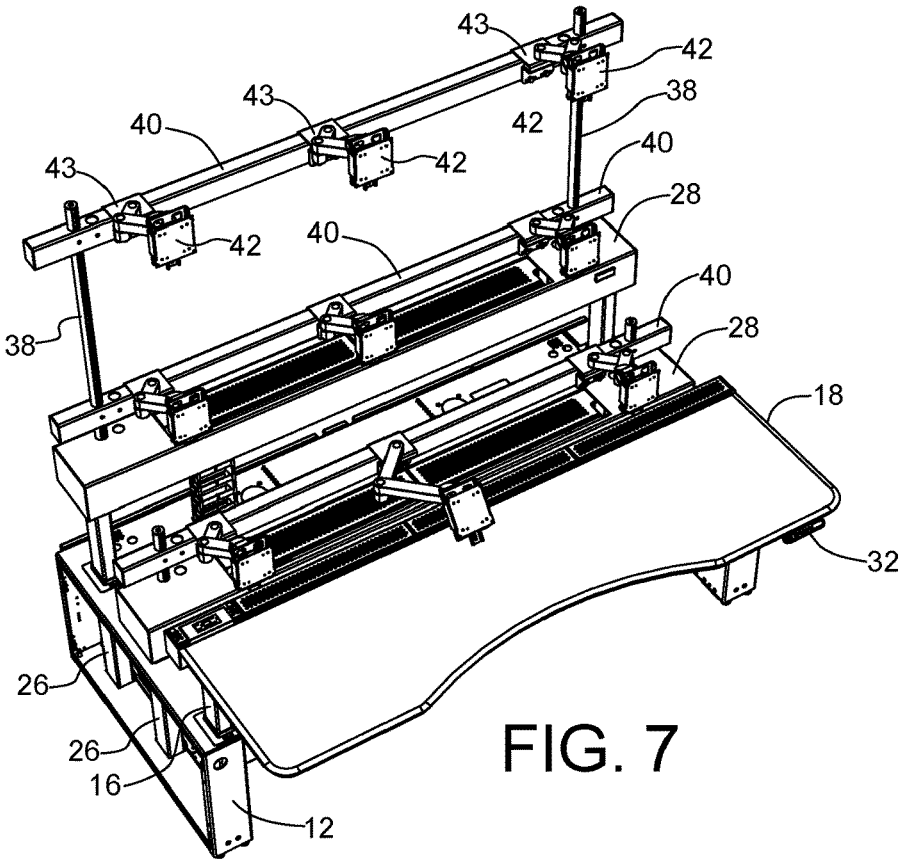
FIG. 7 is a top front perspective view of the configurable workstation shown in FIG. 1, wherein an equipment support assembly at a rear zone of the workstation has a dual-rail configuration.

Each secondary rack 28 may be provided with structure that enables equipment to be removably mounted on the secondary rack for motorized vertical travel with the secondary rack. In the embodiment shown, a pair of support posts 38 are arranged to extend upwardly from each secondary rack 28, and an equipment rail 40 extends horizontally between the support posts 38. The length of support posts 38 may be chosen such that a plurality of equipment rails 40 can be arranged on the same pair of support posts 38 at different elevations, as depicted in FIG. 7. Support posts 38 may have a series of mounting holes at discrete intervals along their length, and equipment rails 40 may be slidably mounted on support posts 38 and manually settable at a chosen elevation on the support posts by dowels or pegs insertable through a respective mounting hole in the equipment rail and an aligned mounting hole in the support post.

Figure 5:
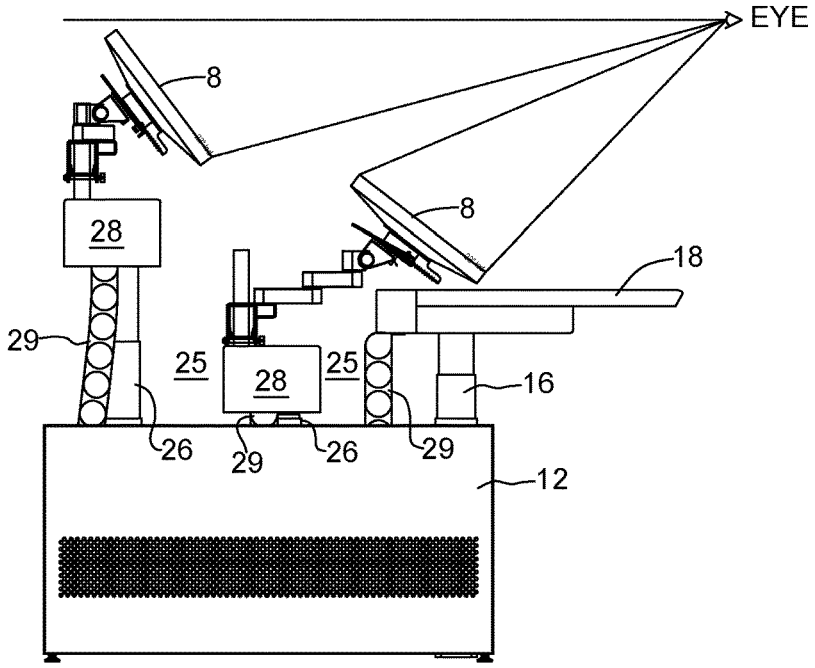
FIG. 5 is a side elevational view of the configurable workstation shown in FIG. 1.
Figure 6:
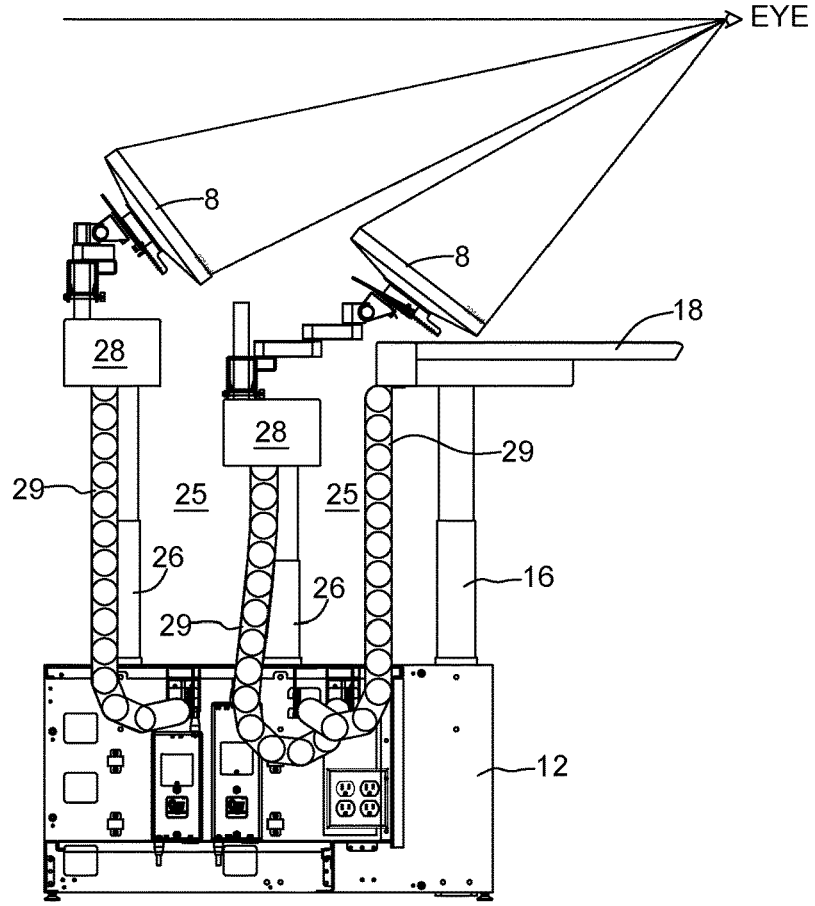
FIG. 6 is a sectional side view of the configurable workstation shown in FIG. 1, illustrating elevation adjustment of equipment support assemblies in respective zones of the workstation.

A plurality of support brackets 42 may be removably mounted on the at least one equipment rail 40. Each support bracket 42 is configured to hold a piece of equipment 8, such as a display screen, touch screen, speaker, camera, or switching device. Support brackets 42 may include an adjustable clamping base 43 operable to clamp the support bracket onto an equipment rail 40 at a chosen location along the equipment rail. Each support bracket 42 may be manually adjustable to allow the equipment mounted thereon to be displaced in a horizontal plane and pivoted about horizontal and vertical tilt axes. Such adjustments permit the equipment to be positioned in an ergonomic arrangement with respect to a user. For example, as shown in FIGS. 5 and 6, display screens 8 situated in second and third zones behind support component 18 may be positioned in a concave arc centered approximately at the user's eye level, and laterally outer screens may be tilted inward slightly. The display screen surfaces thus conform generally to a concave surface centered at the eyes of the user. Consequently, display screens 8 situated in the second and third zones are completely visible to a user along downwardly inclined sightlines when an elevation of workstation 10 is adjusted for a seated user (FIG. 5) and when an elevation of workstation 10 is adjusted for a standing user (FIG. 6). As will be understood from FIGS. 5 and 6, the user may still see over equipment 8 to see and communicate directly with another person. Support brackets 42 may be off-the-shelf monitor arms and other equipment support products available from Innovative Office Products, LLC of Easton, Pa.

In order to store power and data cables that connect to equipment 8, each secondary rack 28 may include a cable tray for accommodating power and data cables. In the illustrated embodiments, secondary racks 28 are in the form of elongated hollow boxes that respectively serve as cable trays for the corresponding support assemblies 24. Workstation 10 may further comprise flexible cable conduits 29 extending between base 12 and the cable trays of secondary racks 28 for gathering and organizing power and data cables routed from computers and power sources within the interior 22 of base 12 to the cable trays.

As will be understood from FIGS. 9-12, support component 18 of primary support assembly 14 may be embodied as a rack instead of a work deck, and workstation 10 may further comprise a plurality of support brackets 44 mounted on the rack 18, wherein each support bracket 44 is configured to hold a respective display screen, touch screen, or other piece of equipment 8. Rack 18 may include a plurality of mounting holes 46 different locations, and support brackets 44 may have a stand post 45 sized to mate with the plurality of mounting holes 46 such that each support bracket 44 can be selectively positioned at a chosen mounting hole 46 on rack 18. Thus, one or more support brackets 44 may be selectively positioned in a chosen spatial configuration on rack 18.

Figure 11:
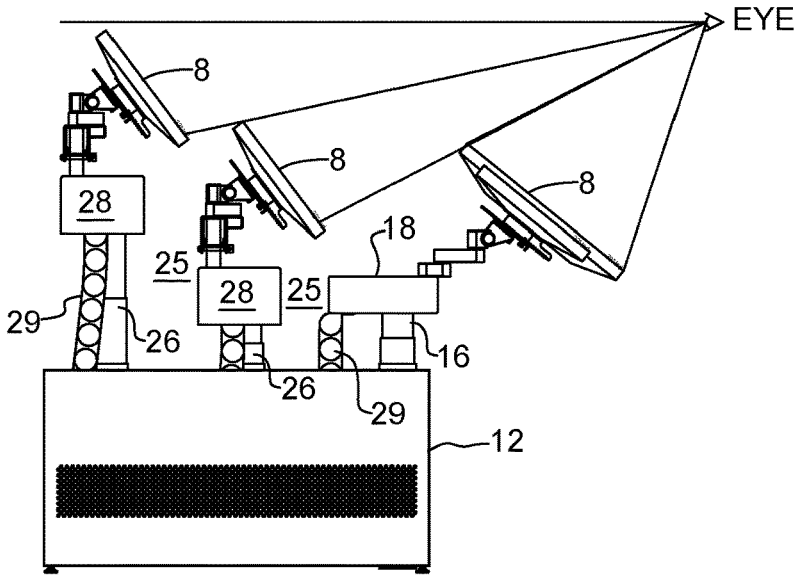
FIG. 11 is a side elevational view of the configurable workstation shown in FIG. 9.
Figure 12:
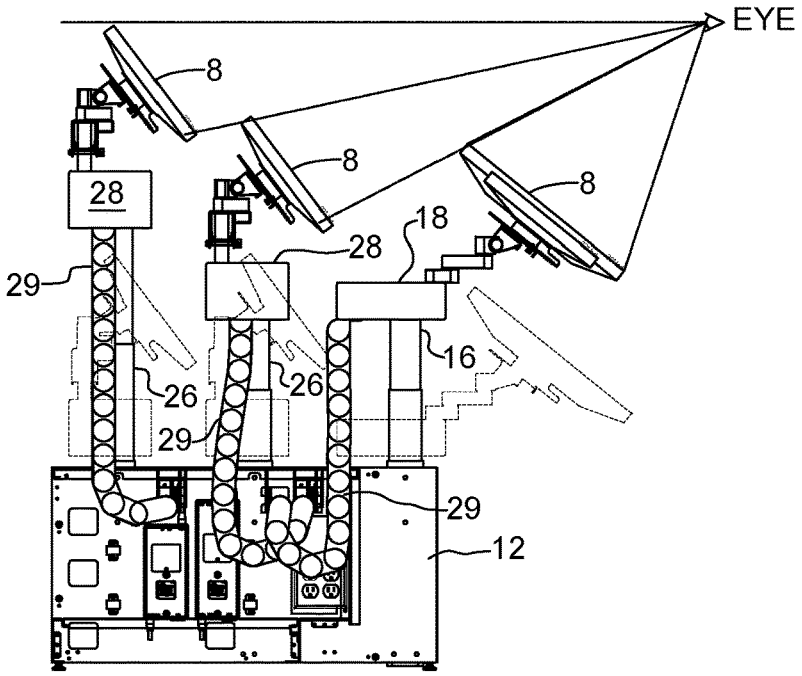
FIG. 12 is a sectional side view of the configurable workstation shown in FIG. 9, illustrating elevation adjustment of equipment support assemblies in respective zones of the workstation.

Each support bracket 44 may be manually adjustable to allow the equipment mounted thereon to be displaced in a horizontal plane and pivoted about horizontal and vertical tilt axes. Such adjustments permit the equipment to be positioned in an ergonomic arrangement with respect to a user. For example, as shown in FIGS. 11 and 12, screens 8 situated in the first or frontal zone may be positioned so as to be completely visible and accessible to a user without blocking the user's sight lines to screens and equipment in the second and third zones behind the first zone. The elevation of all three zones may be adjusted for a shorter user (FIG. 11) and a taller user (FIG. 12). As will be understood from FIGS. 11 and 12, the user may look overtop the equipment 8 to see and communicate directly with another person. Support brackets 44 may be off-the-shelf monitor arms and other equipment support products available from Innovative Office Products, LLC of Easton, Pa.

Rack 18 may include a cable tray 21 to store power and data cables that connect to equipment 8. A flexible cable conduit 29 may be arranged to extend between base 12 and cable tray 21 as shown in FIGS. 11 and 12.

Figure 4:
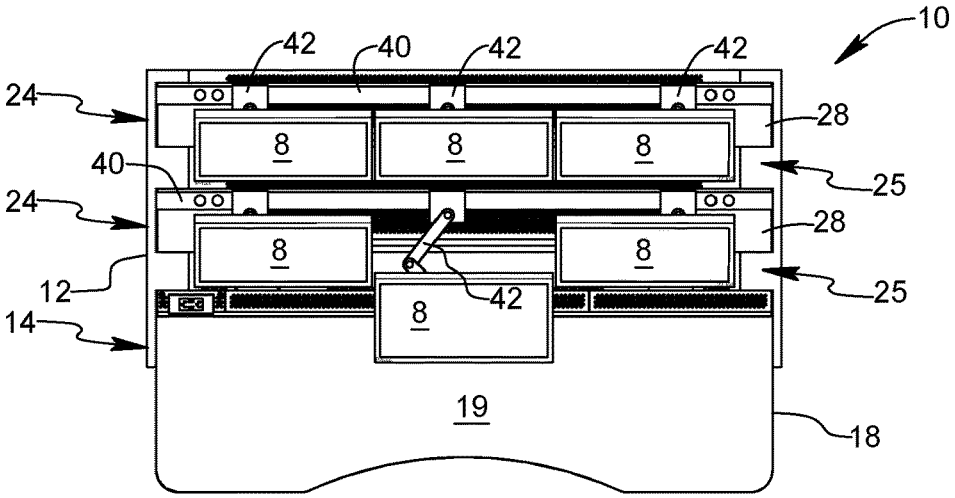
FIG. 4 is a top plan view of the configurable workstation shown in FIG. 1.
Figure 10:
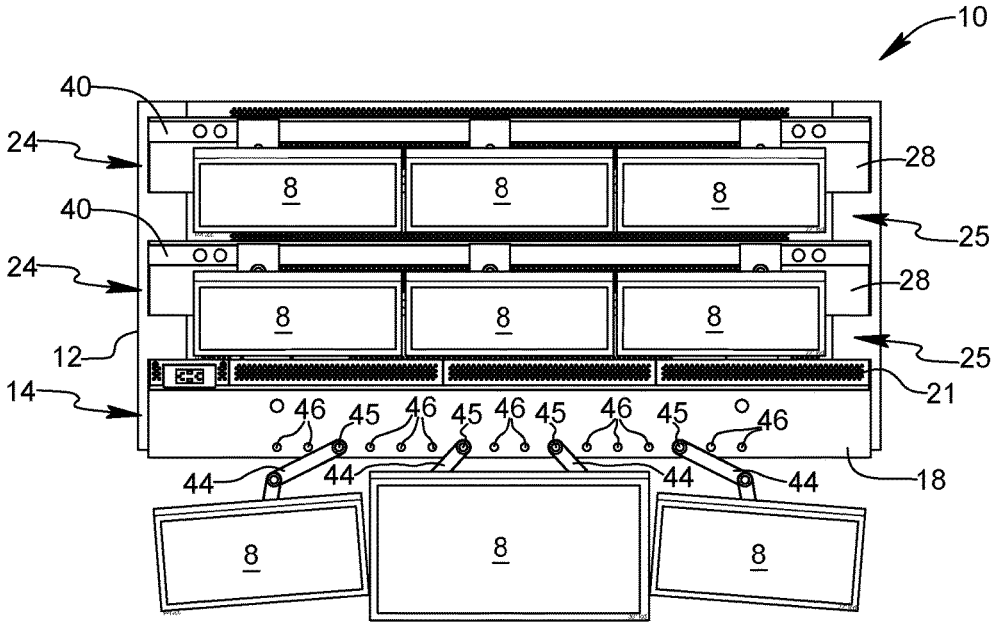
FIG. 10 is a top plan view of the configurable workstation shown in FIG. 9.

As will be apparent from the plan views of FIGS. 4 and 10, the secondary rack 28 of the second zone may be spaced apart from the support component 18 of the first zone in a depth direction of configurable workstation 10, and the respective secondary racks 28 of any further zones (e.g., the third zone) may be spaced apart from the secondary rack 28 of a preceding adjacent zone in a depth direction of the configurable workstation. Such spacing provides a series of gap regions 25 between support component 18 and adjacent secondary racks 28 so that heat rising from computers and equipment within base 12 may escape workstation 10 and safely dissipate. Additionally, the gap regions 25 between support component 18 and adjacent secondary racks 28 provides room for vertically adjusting a secondary support assembly 24 downward to locate equipment 8 supported thereby in a recessed position relative to another support assembly 14 or 24 in front of it. In other words, a lower portion of equipment 8 may be positioned in the gap region 25 between support component 18 and the adjacent secondary rack 28, or in the gap region 25 between two adjacent secondary racks 28. Such adjustments may be necessary to accommodate specific equipment, for example large display monitors. In one embodiment, a gap region of about six inches is provided, however gap regions ranging from one inch to twenty inches are considered suitable.

Figure 13:
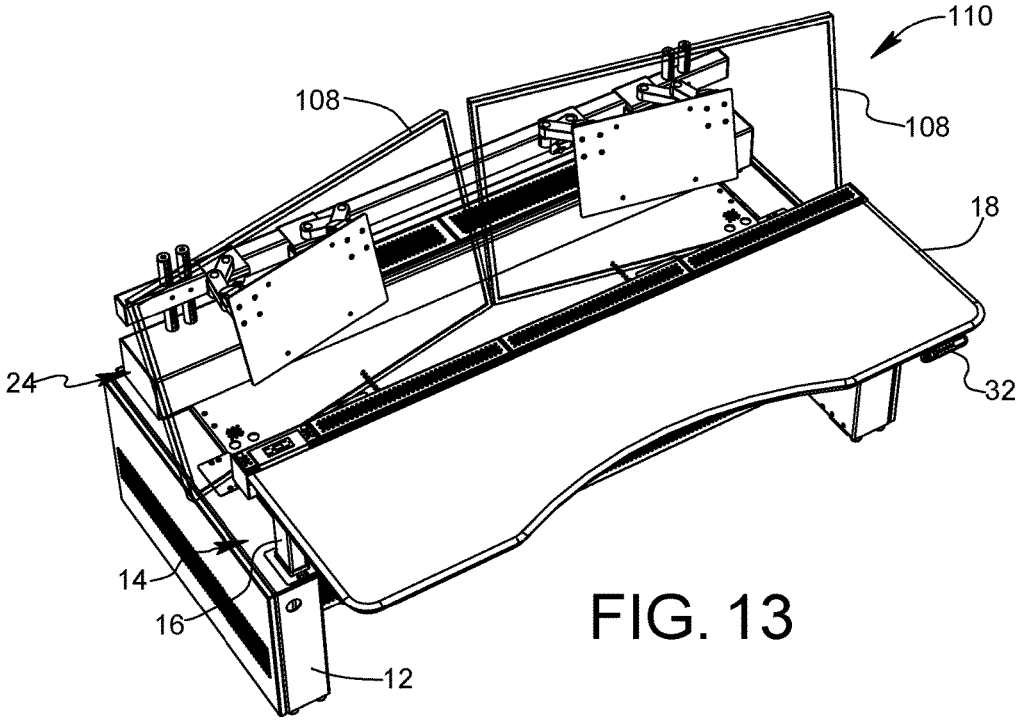
FIG. 13 is a front perspective view of a configurable workstation formed in accordance with a third embodiment of the present invention.
Figure 14:
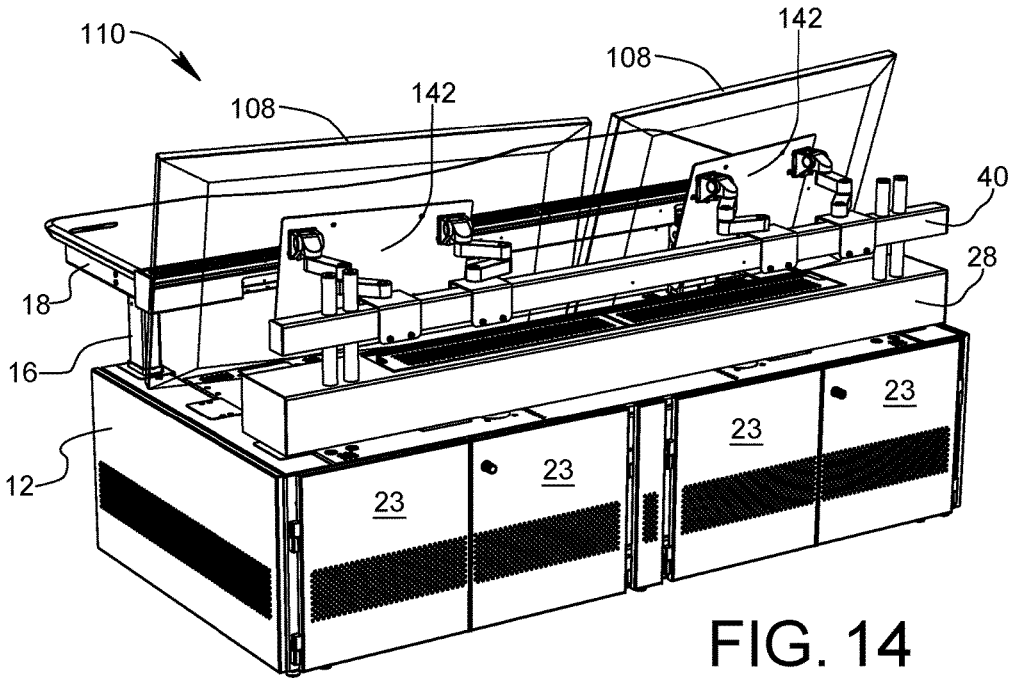
FIG. 14 is rear perspective view of the configurable workstation shown in FIG. 13.
Figure 15:
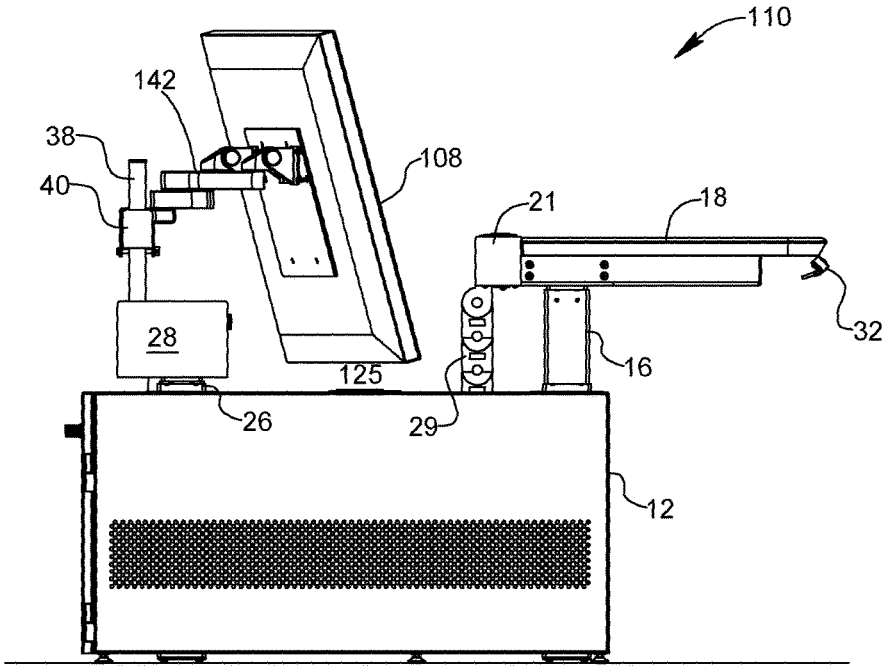
FIG. 15 is a side elevational view of the configurable workstation shown in FIG. 13.
Figure 16:
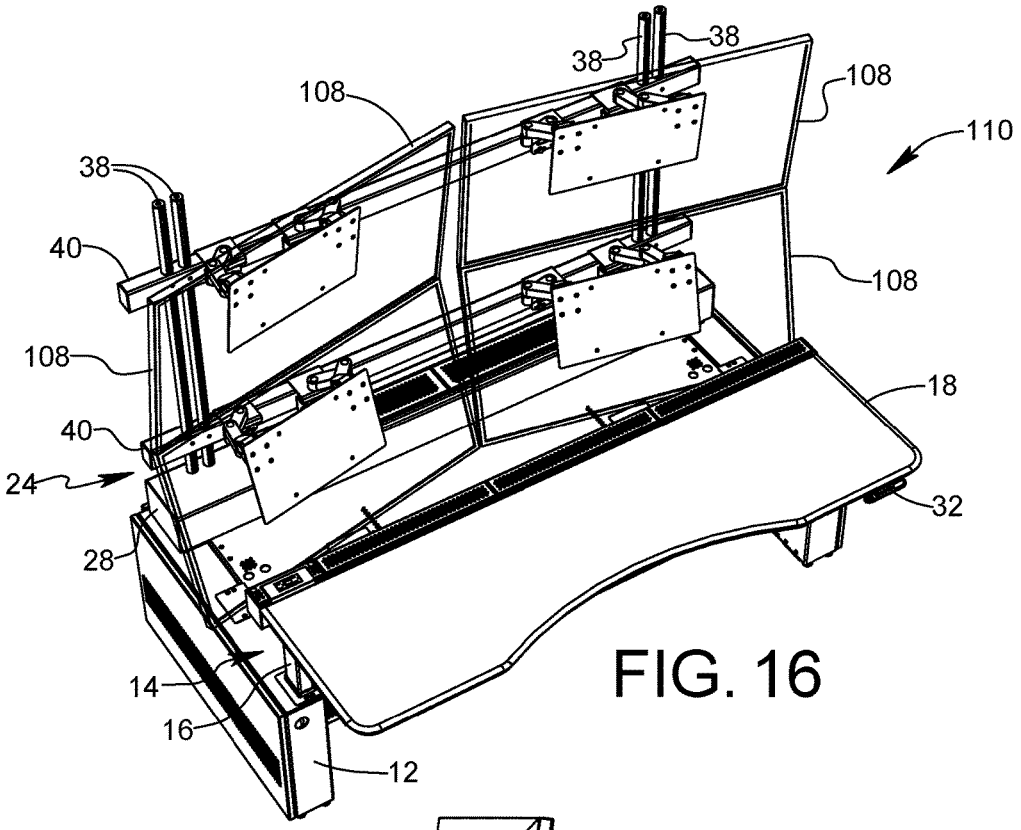
FIG. 16 is a front perspective view of the configurable workstation shown in FIG. 13, illustrating a vertically extended rear zone variation thereof.

FIGS. 13-15 illustrate a configurable workstation 110 formed in accordance with a second embodiment of the present invention. Workstation 110 is similar to the triple zone workstation 10 of the first embodiment, however a middle zone is removed to provide a dual zone configuration having a primary support assembly 14 and a secondary support assembly 24 separated by a wider gap region 125 in the depth direction. The secondary rack 28 of secondary support assembly 24 is spaced apart from the support component 18 of primary support assembly 14 in the depth direction of configurable workstation 110 by at least twelve inches, preferably about sixteen inches. A pair of support posts 38 are arranged to extend upwardly from secondary rack 28, and an equipment rail 40 extends horizontally between the support posts 38. Workstation 110 is well-suited for providing side-by-side large display screens 108 mounted on equipment rail 40 by respective heavy duty support brackets 142. As best seen in FIG. 16, each heavy duty support bracket 142 is configured to hold a large screen display 108 and may include a pair of adjustable clamping bases 143 operable to clamp the support bracket 142 onto an equipment rail 40 at a chosen location along the equipment rail. Each support bracket 142 may be manually adjustable to allow the equipment mounted thereon to be displaced in a horizontal plane and pivoted about horizontal and vertical tilt axes. Heavy-duty support brackets 142 may be off-the-shelf monitor arms and other equipment support products available from Innovative Office Products, LLC of Easton, Pa.

As will be understood from FIG. 15, a lower portion of each display screen 108 is selectively positionable in the gap region 125 between secondary rack 28 and support component 18. The gap region 125 allows for tilting adjustment of each display screen 108. Such adjustments permit display screens 108 to be positioned in a somewhat recessed relationship relative to support component 18 and to be tilted upwardly and toward a center of workstation 110, whereby a user in front of support component 18 can simultaneously access work surface 19 of the support component, view the entirety of each display screen 108, and communicate with another person standing behind workstation 110. In FIGS. 13-15, support component 18 is embodied as a work deck. Alternatively, support component 18 may be embodied as a rack configured to support a plurality of display screens or other equipment.

Figure 17:
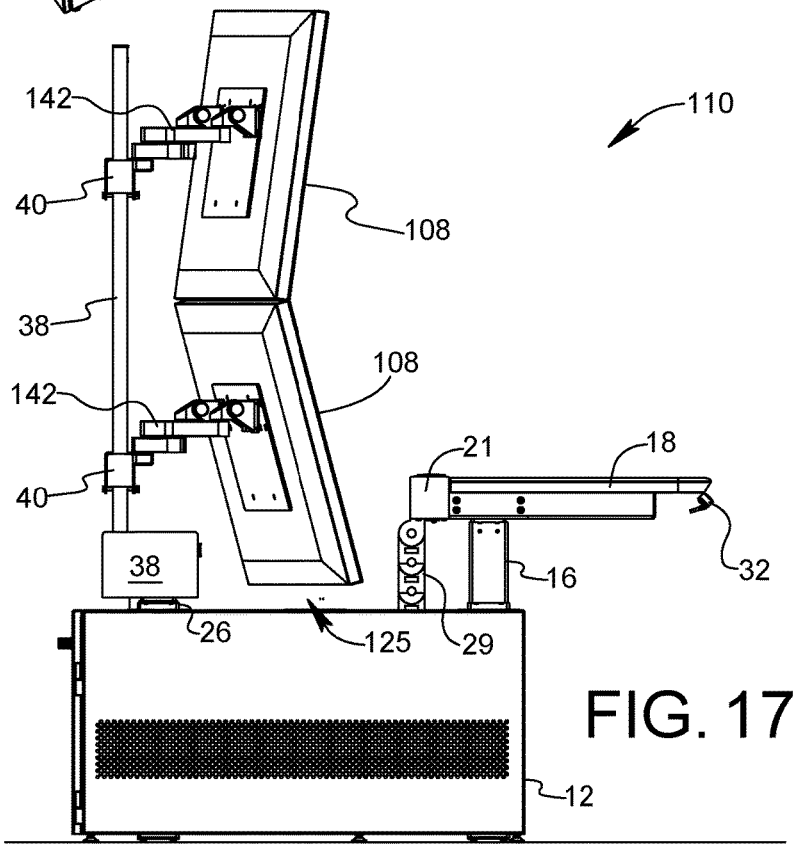
FIG. 17 is a side elevational view of the configurable workstation shown in FIG. 16.

FIGS. 16 and 17 illustrate a variation of configurable workstation 110 wherein taller support posts 38 and two equipment rails 40 are provided. As may be seen, a two-by-two array of large display screens 108 can be supported. A lower portion of each display screen 108 in the bottom row is selectively positionable in the gap region 125 between secondary rack 28 and support component 18, and may be tilted upward and toward the center of workstation 110 as shown in FIG. 17.

Workstation 110 is similar to workstation 10 of the first embodiment with respect to automatic adjustability. Legs 16 of the front zone are adjustable by motor drive system 20 to raise and lower support component 18. Likewise, legs 26, 26 of the rear zone are adjustable by motor drive system 20 to raise and lower secondary rack 28. Vertical adjustment of support component 18 and vertical adjustment of secondary rack 28 may be commanded independently through user interface 32. A synchronized vertical adjustment of support component 18 and secondary rack 28 may also be provided via user interface 32.

Figure 18:
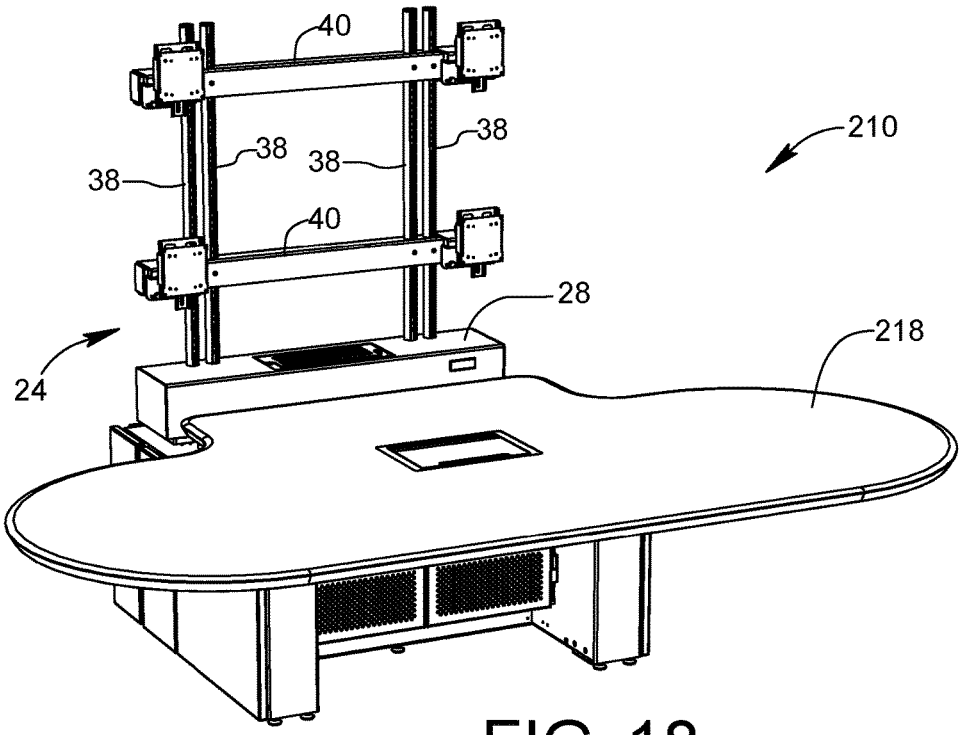
FIG. 18 is a front perspective view of a configurable workstation formed in accordance with a third embodiment of the present invention, wherein the workstation includes a conference table.
Figure 19:
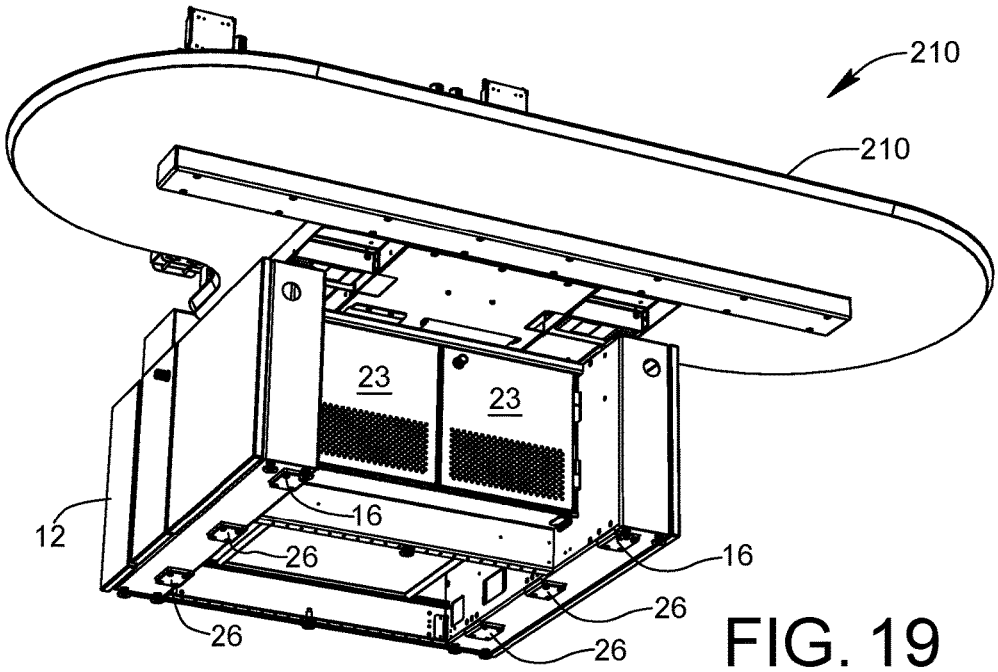
FIG. 19 is a bottom front perspective view of the configurable workstation shown in FIG. 18.

FIGS. 18 and 19 depict a configurable workstation 210 formed in accordance with a third embodiment of the present invention. Workstation 210 is generally similar to workstation 110 of the second embodiment, except that a conference table 218 is supported by primary legs 16 and the adjacent set of secondary legs 26 mounted to base 12. In other words, the two zones at the front of workstation 210 are dedicated to supporting conference table 218 for automated height adjustment by motor drive system 20. Conference table 218 is shown, by way of example, as a five person conference table. A support assembly 24 including a rack 28 is provided behind the conference table 218 in the third (i.e. rear) zone on base 12. In the depicted configuration, rack 28 extends horizontally between the rear pair of legs 26, a pair of support posts 38 extend upwardly from rack 28, and multiple equipment rails 40 extend horizontally between the pair of support posts 38. Rack 28 may support equipment, such as a plurality of display screens 108, as taught in the embodiments described above. Vertical adjustment of conference table 218 and vertical adjustment of rack 28 may be commanded independently through user interface 32. A synchronized vertical adjustment of conference table 218 and rack 28 may also be commanded via user interface 32. Thus, persons seated at conference table 218 may comfortably view the display screens 108.

Figure 20:
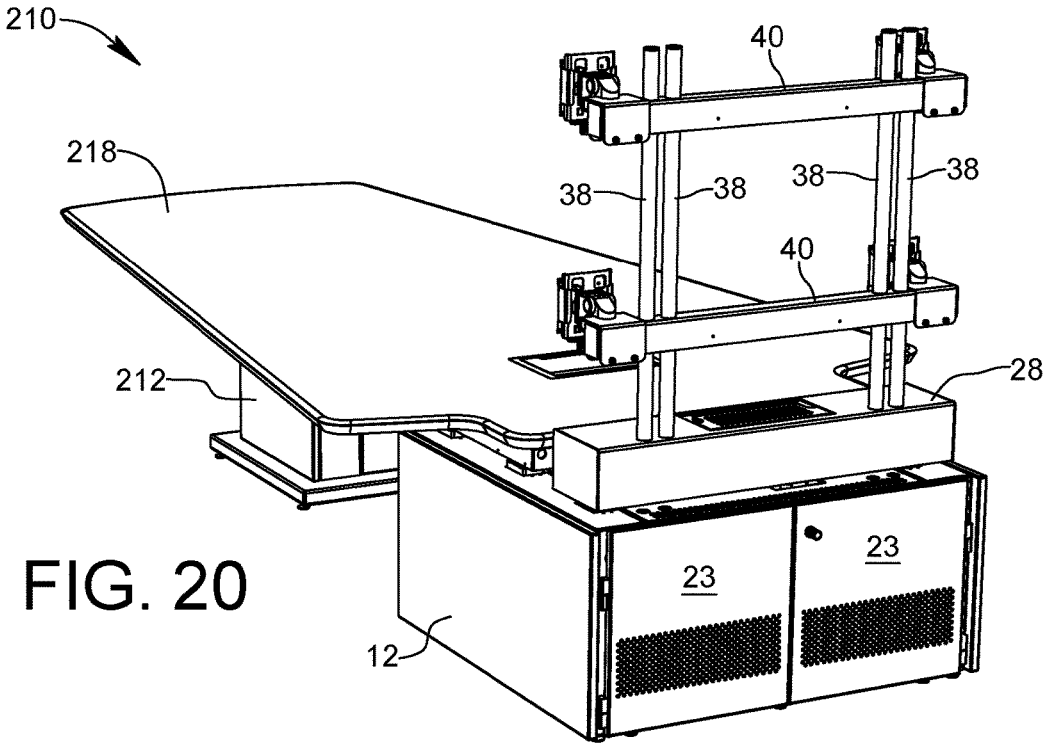
FIG. 20 is a front perspective view of a configurable workstation formed in accordance with the third embodiment of the present invention, illustrating a variation thereof having an elongated conference table and an auxiliary base.
Figure 21:
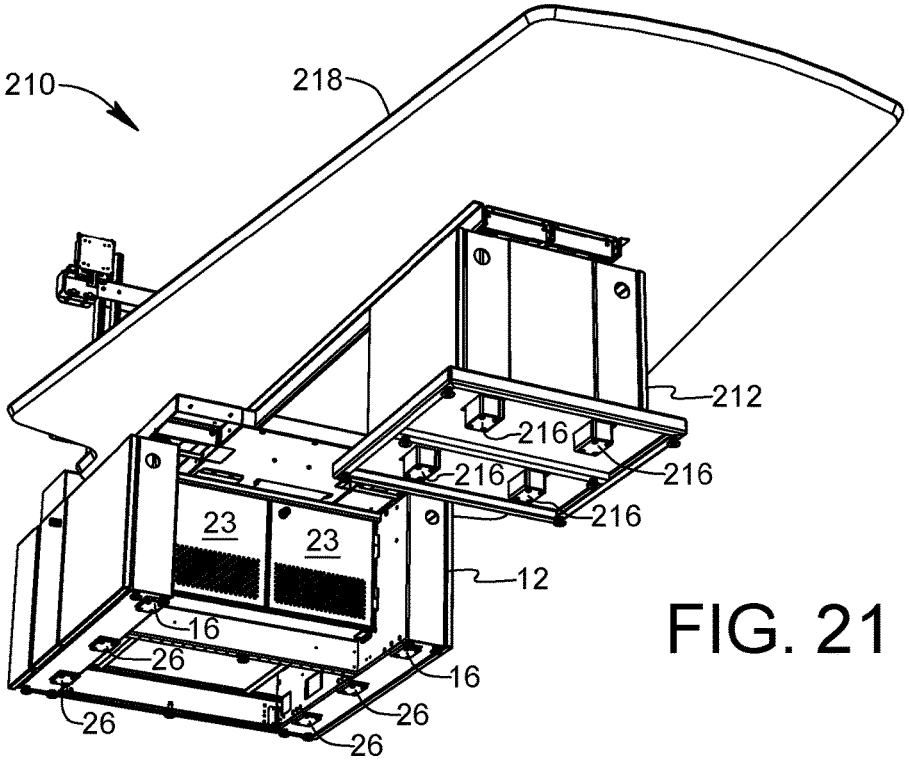
FIG. 21 is a bottom front perspective view of the configurable workstation shown in FIG. 20.

FIGS. 20 and 21 illustrate a variation of configurable workstation 210 in which the conference table 218 extends out farther from base 12, and an auxiliary base 212 is spaced from the main base 12. Conference table 218 is shown, by way of example, as a seven person conference table. The longer conference table 218 is further supported by a plurality of auxiliary legs 216 mounted to auxiliary base 212. Auxiliary legs 216 are vertically adjustable relative to auxiliary base 212 by motor drive system 20 in synchronization with legs 16 and 26 that support conference table 218 on main base 12, whereby the elevation of conference table 218 may be automatically adjusted. Vertical adjustment of conference table 218 and vertical adjustment of rack 28 may be commanded independently through user interface 32. A synchronized vertical adjustment of conference table 218 and rack 28 may also be commanded through user interface 32. Here again, the respective elevations of conference table 218 and rack 28, and the opposition and orientation of display screens 108, may be fine-tuned to provide a comfortable view of display screens 108 to all persons seated at conference table 218.

As may be understood from the various embodiments, a common base 12 may be used in practicing each embodiment, or bases having different footprints may be used. In each of the illustrative embodiments, the base 12 has one pair of primary legs 16 and two pairs of secondary legs 26 mounted thereon. The invention may also be implemented using a shallower base having one pair of primary legs 16 and only one pair of secondary legs 26 mounted thereon. Conversely, the invention may be implemented using a deeper base having one pair of primary legs 16 and more than two pairs of secondary legs 26 mounted thereon.

The present invention provides a configurable workstation that improves the capacity of the operator to see and be seen. The configurable workstation may be arranged such that all of the equipment interfaces are below the operator's horizontal line of sight. In this arrangement, the operator may be able to monitor visible events, for example out of a window. Furthermore, the equipment interfaces do not block the operator from being seen by others.

The present invention provides a configurable workstation that accommodates the comfort of a wide range of operator heights and operator positions. The configurable workstation is capable of raising and lowering the equipment interfaces and work surfaces independently or in tandem with one another. Therefore, the configurable workstation may accommodate operators in a wide range of heights. Furthermore, the configurable workstation may accommodate operators who are sitting or standing. By adjusting the height of the equipment interfaces to an optimal position, the operator may be less strained, thereby mitigating operator fatigue. An optimal position of the equipment interfaces may approximate a concave arc or concave surface centered at the user's eye level, and laterally outer screens may be tilted inward slightly toward the center of the workstation. The display screen surfaces thus conform generally to a concave surface centered at the eyes of the operator. The motor drives may be programmed to adjust to the optimal position of a specific operator.

The present invention provides a configurable workstation that allows for ample heat dissipation. The gap regions between adjacent zones allow heat generated by CPUs and other equipment stored in the base to escape. Therefore, the risk of overheated equipment is reduced.

While the invention has been described in connection with exemplary embodiments, the detailed description is not intended to limit the scope of the invention to the particular forms set forth. The invention is intended to cover such alternatives, modifications and equivalents of the described embodiments as may be included within the scope of the invention.

What is claimed is:

1. A configurable workstation comprising:

a base;

a primary support assembly including a pair of legs mounted to the base and a support component extending horizontally between the pair of legs, the pair of legs being vertically adjustable relative to the base; and at least two secondary support assemblies arranged sequentially in a depth direction behind the primary support assembly, each secondary support assembly including a pair of secondary legs mounted to the base and vertically adjustable relative to the base, a secondary rack extending horizontally between the pair of secondary legs, a pair of support posts extending upwardly from the secondary rack, and at least one equipment rail extending horizontally between the pair of support posts;

a motor drive system operable to automatically adjust the pair of legs of the primary support assembly vertically relative to the base to adjust an elevation of the support component, and is operable to automatically adjust each pair of secondary legs vertically relative to the base to adjust an elevation of the secondary rack supported by such pair of secondary legs; and a plurality of support brackets removably mounted on the at least one equipment rail of each secondary support assembly, each support bracket being configured to hold a respective display screen;

wherein the motor drive system is operable to independently adjust the elevations of the support component and each of the secondary racks; and wherein the secondary rack of the secondary support assembly directly behind the primary support assembly is spaced apart from the support component in the depth direction of the configurable workstation to define a gap region between the support component and such secondary rack, whereby a lower portion of the display screen held by one of the plurality of support brackets is selectively positionable in the gap region and heat generated within the base may dissipate upwardly through the gap region away from the configurable workstation.

2. The configurable workstation according to claim 1, wherein the motor drive system is further operable using only a single input command to adjust the elevations of the support component and each of the secondary racks in unison.

3. The configurable workstation according to claim 1, wherein the support component is a rack configured to support a plurality of display screens.

4. The configurable workstation according to claim 3, further comprising a plurality of support brackets mounted on the rack, each support bracket being configured to hold a respective display screen.

5. The configurable workstation according to claim 4, wherein the rack includes a plurality of mounting holes at different locations, and at least one of the plurality of support brackets includes a stand post sized to mate with the plurality of mounting holes, whereby the at least one support bracket is selectively positioned at a chosen mounting hole on the rack.

6. The configurable workstation according to claim 3, wherein the rack includes a cable tray for accommodating power and data cables.

7. The configurable workstation according to claim 6, further comprising a flexible conduit extending between the base and the cable tray for accommodating power and data cables.

8. The configurable workstation according to claim 1, wherein the support component is a work deck having a flat work surface.

9. The configurable workstation according to claim 1, wherein the at least one equipment rail of each secondary support assembly is vertically adjustable along the pair of support posts relative to the secondary rack of such secondary support assembly.

10. The configurable workstation according to claim 1, wherein the secondary rack of the secondary support assembly directly behind the primary support assembly is spaced apart from the support component in the depth direction of the configurable workstation by at least twelve inches.

11. The configurable workstation according to claim 1, wherein at least one of the plurality of support brackets includes an adjustable clamping base operable to clamp the at least one support bracket onto the equipment rail at a chosen location along the equipment rail.

12. The configurable workstation according to claim 1, wherein at least one of the secondary support assemblies includes a plurality of equipment rails extending horizontally between the pair of support posts.

13. The configurable workstation according to claim 1, wherein each secondary rack includes a cable tray for accommodating power and data cables.

14. The configurable workstation according to claim 13, further comprising a plurality of flexible conduits extending between the base and the cable tray of each secondary rack for accommodating power and data cables.

15. The configurable workstation according to claim 1, wherein the respective secondary racks of the at least two secondary support assemblies are spaced apart from one another in a depth direction of the configurable workstation to provide a gap region between the secondary racks of adjacent secondary support assemblies, whereby heat generated within the base may dissipate upwardly through the gap region away from the configurable workstation.

* * * * *